United States Patent [19]

Spruill et al.

[11] Patent Number: 5,035,731

[45] Date of Patent: Jul. 30, 1991

[54] DEVICE FOR CONTROLLING RELATIVE HUMIDITY WITHIN A SUBSTANTIALLY SEALED CONTAINER

[75] Inventors: David B. Spruill; Joseph L. Banyasz; Thomas V. Van Auken, all of Richmond, Va.

[73] Assignee: Philip Morris Management Corp., Richmond, Va.

[21] Appl. No.: 502,505

[22] Filed: Mar. 30, 1990

Related U.S. Application Data

[63] Continuation-in-part of Ser. No. 483,976, Feb. 20, 1990, which is a continuation of Ser. No. 254,566, Oct. 7, 1988, abandoned.

[51] Int. Cl.[5] ..... B01D 53/02

[52] U.S. Cl. ..... 55/387; 55/384; 55/388; 206/0.7; 206/204; 426/118

[58] Field of Search ..... 55/29, 33, 35, 384, 55/387–389; 206/0.7, 204, 205; 426/118, 124, 324

[56] References Cited

U.S. PATENT DOCUMENTS

| | | | |
|---|---|---|---|
| Re. 32,513 | 10/1987 | Seaber et al. | 239/6 |
| 339,792 | 4/1886 | Levi . | |
| 1,222,656 | 4/1917 | Moyer | 55/384 X |
| 1,241,695 | 10/1917 | Alexander . | |
| 1,268,135 | 6/1918 | McElroy | 55/29 X |
| 1,425,790 | 8/1922 | Moyer | 55/388 X |
| 1,481,971 | 1/1924 | Whiting | 55/387 X |
| 1,556,951 | 10/1925 | Marshall . | |
| 1,841,889 | 1/1932 | Grünwald . | |
| 1,866,560 | 7/1932 | Gordon | 55/29 |
| 1,871,418 | 8/1932 | McKee | 55/384 X |
| 1,871,419 | 8/1932 | McKee . | |
| 1,967,554 | 7/1934 | Gross et al. | 131/30 |
| 1,972,118 | 9/1934 | McDill | 131/55 |
| 1,998,683 | 4/1935 | Montgomery | 131/55 |
| 2,007,632 | 7/1935 | Blank et al. | 206/205 X |
| 2,085,600 | 6/1937 | Petersen | 206/41 |
| 2,169,055 | 8/1939 | Overshiner | 167/94 |
| 2,227,158 | 12/1940 | Saul | 206/205 X |
| 2,236,024 | 3/1941 | Tyler | 312/31.2 |
| 2,270,603 | 1/1942 | Ridder | 252/194 |
| 2,329,908 | 9/1943 | Johnson | 312/31 |
| 2,333,270 | 11/1943 | Opler | 206/205 X |
| 2,368,140 | 1/1945 | Johnson | 312/31 |
| 2,452,957 | 11/1948 | Sabin | 299/24 |
| 2,458,695 | 1/1949 | Edelston | 55/387 X |
| 2,545,710 | 3/1951 | Snyder | 312/31 |
| 2,740,683 | 4/1956 | June | 206/205 X |
| 2,758,932 | 8/1956 | Scott | 99/171 |
| 2,807,514 | 9/1957 | Williams | 312/31 |
| 2,862,779 | 12/1958 | Hammond | 206/205 X |
| 3,204,388 | 9/1965 | Asker | 55/33 X |
| 3,211,503 | 10/1965 | Barnes | 312/31.2 |
| 3,315,447 | 4/1967 | Meier | 55/384 |
| 3,578,545 | 5/1971 | Carson et al. | 161/86 |
| 3,722,188 | 3/1973 | Cullen | 55/384 |
| 3,785,556 | 1/1974 | Watkins | 239/6 |
| 3,801,011 | 4/1974 | Guehler et al. | 239/34 |
| 3,809,223 | 5/1974 | Kendall | 206/204 |
| 3,815,828 | 6/1974 | Engel | 239/56 |
| 3,897,226 | 7/1975 | Doherty | 55/33 |
| 3,990,872 | 11/1976 | Cullen | 55/289 X |

(List continued on next page.)

FOREIGN PATENT DOCUMENTS

| | | | |
|---|---|---|---|
| 348840 | 1/1990 | European Pat. Off. . | |
| 1246918 | 10/1960 | France | 55/384 |
| 478793 | 1/1938 | United Kingdom | 206/204 |
| 2222816 | 3/1990 | United Kingdom . | |

*Primary Examiner*—Robert Spitzer

*Attorney, Agent, or Firm*—Jeffrey H. Ingerman; Eric R. Hubbard

[57] ABSTRACT

An insert for inclusion in a substantially sealed container to control the relative humidity within the container is provided. The insert is a packet at least part of the surface of which is a membrane capable of passing water vapor and which contains a buffering substance which is a saturated salt solution selected according to the desired relative humidity, and modified by a non-electrolyte, if necessary, to adjust the relative humidity.

26 Claims, 9 Drawing Sheets

U.S. PATENT DOCUMENTS

| | | | |
|---|---|---|---|
| 4,027,068 | 5/1977 | Saad | 428/426 |
| 4,145,001 | 3/1979 | Weyenberg et al. | 239/56 |
| 4,158,440 | 6/1979 | Sullivan et al. | 239/1 |
| 4,161,283 | 7/1979 | Hyman | 239/55 |
| 4,192,773 | 3/1980 | Yashikawa et al. | 426/124 X |
| 4,223,070 | 9/1980 | Hahn et al. | 428/407 |
| 4,285,468 | 8/1981 | Hyman | 239/55 |
| 4,287,995 | 9/1981 | Moriya | 426/124 X |
| 4,423,080 | 12/1983 | Bedrosian et al. | 426/124 |
| 4,445,641 | 5/1984 | Baker et al. | 239/6 |
| 4,528,228 | 7/1985 | Clevenger | 426/124 X |
| 4,550,026 | 10/1985 | Ando | 426/124 X |
| 4,579,223 | 4/1986 | Otsuka et al. | 426/124 X |
| 4,594,082 | 6/1986 | Catherwood, Sr. | 55/387 X |
| 4,614,528 | 9/1986 | Lennen | 55/387 X |
| 4,615,923 | 10/1986 | Marx | 426/124 X |
| 4,645,698 | 2/1987 | Matsubara | 426/124 X |
| 4,657,610 | 4/1987 | Komatsu et al. | 426/124 X |
| 4,674,630 | 6/1987 | Kirck | 206/205 |
| 4,686,776 | 8/1987 | Matsubara | 426/124 X |
| 4,749,392 | 6/1988 | Aoki et al. | 55/387 |
| 4,756,726 | 7/1988 | Peace | 55/387 X |
| 4,772,300 | 9/1988 | Cullen et al. | 55/387 |
| 4,783,206 | 11/1988 | Cullen et al. | 55/387 |
| 4,792,484 | 12/1988 | Moritami | 206/204 X |
| 4,819,342 | 4/1989 | Matsubara et al. | 426/124 X |
| 4,934,524 | 6/1990 | St. Charles | 206/204 |

| | N | R | SD | C1 | C2 |
|---|---|---|---|---|---|
| O = | 4 | 0.9912 | 0.1648 | 61.44 | −0.0732 |

Y = C1 + C2 times X

X : COMMERCIAL TOBACCO AT OV OF 13.35%

O : HUMIDOR SOLUTION

LINE IS BEST FIT TO HUMIDOR POINTS

DEVICE FOR CONTROLLING RELATIVE HUMIDITY WITHIN A SUBSTANTIALLY SEALED CONTAINER

This application is a continuation-in-part of Ser. No. 07/483,976, filed Feb. 20, 1990, which is a continuation of Ser. No. 07/254,566, filed Oct. 7, 1988, now abandoned.

BACKGROUND OF THE INVENTION

This invention relates to controlling the relative humidity within a substantially sealed container, such as a package of food or a pack of cigarettes. More particularly, this invention relates to a device for inclusion in a substantially sealed container for maintaining a desired degree of relative humidity within the container.

Many products are packaged today within a transparent film overwrapping the entire package. This overwrap film has several purposes, but one of its most important functions is to act as a moisture barrier. Certain products—among them being foods and tobacco products—need to have a particular moisture content in order to be satisfactory to the consumer. If the product is too wet or too dry, it may convey a negative impression to consumers. The manufacturer can easily set the moisture level in the product at the factory, but must then depend on the overwrap film to keep moisture in or out of the package as needed until the product is consumed.

It is difficult to make a perfect moisture barrier with a typical film made from commercially available polymeric materials such as polyethylene, polypropylene, nylon-6, nylon-66, polyvinyl chloride, polyvinylidene chloride, or cellophane. There are two basic effects which prevent a perfect moisture barrier from being formed. First, the films covering packages may be imperfectly sealed in a manufacturing process. Secondly, polymeric films may not be totally impermeable to moisture vapor. That is, the moisture vapor may pass directly through the film as well as through poor seals.

It is desirable to have a practical means of maintaining a particular set relative humidity (RH)* or water activity ($A_w$)** inside a package from the time it leaves the manufacturing plant until it is opened by the consumer. This way the product in the package will reach the consumer with the proper moisture content. * RH, or "relative humidity", is the amount of water vapor present in air at a particular temperature, expressed as a percentage of the total amount of water vapor which can be in the same quantity of air at that temperature. ** $A_w$, or "water activity", is equal to RH/100—the decimal equivalent of RH.

Any system for controlling the relative humidity in a package must be able to cope with both moisture absorbed into the package from a very humid external environment, and with loss of moisture from the package into a very dry external environment.

Known methods for controlling the relative humidity in a package, or supplying moisture to the contents of a package, include putting into the package an absorbent material, such as blotter board, impregnated with water or other materials, so that the absorbent material will release its contents over time into the interior of the package. Another known method is to include in the package a pouch of cellophane or other porous or microporous cellulosic or polymeric membrane. The pouch encloses a hydrated salt which releases water vapor over time through the membrane into the pack.

These methods do not work well. The first method—putting wet blotter board, or some other water carrier into the package—simply puts excess water into the package or container. Initially the contents of the package will have too high a moisture level, and then, as the excess water is lost from the package, the contents will dry out. This method provides no means of stabilizing the relative humidity within the package at a desired level.

The second method—putting a hydrated salt inside a package—does give a buffering effect which helps stabilize the relative humidity in the package at a particular level. However, most hydrated salts establish an equilibrium relative humidity which is wrong—usually much too high for most packaging applications, and certainly for foods and for tobacco products. Furthermore, their RH buffering capacities per unit weight are low.

While these known practices are sufficient to prevent the contents of the cigarette pack from drying out for some period of time, until the water in the absorbent material or the hydrated salt is exhausted, there has not been any way to maintain the relative humidity within the pack at a specified desired level. Because cigarette packs are generally sealed in a polypropylene or other polymeric overwrap, when using the known practices the absorbent material or the hydrated salt will give up water to the interior of the pack until some equilibrium, dependent on ambient conditions, is reached. When water vapor leaks out through imperfections in the sealed wrap, additional water is given up by the absorbent or the hydrated salt, until all available water has been given up. Because the relative humidity set this way in the pack may be too high or too low, the cigarettes in the pack may consequently be soggy or dried out.

It has long been known that the equilibrium relative humidity over a hydrated salt or a saturated aqueous salt solution is a function of the temperature and of the hydrated salt or saturated salt solution. Each hydrated salt or saturated salt solution gives a discrete relative humidity at a given temperature. These have long been used as buffering devices to control the relative humidities of closed systems. However, there are some very important practical disadvantages to the use of hydrated salts and saturated salt solutions in the control of relative humidity.

Hydrated salts all have very low buffering capacities. In a truly closed system, this is not too important, but in a system which leaks, or which is enclosed partially or completely by a barrier which is somewhat permeable to water vapor, it is a very important practical issue. Large masses of a hydrated salt might be required to successfully buffer a package enclosed in a typical film such as polypropylene, polyethylene, nylon, cellulose, etc. Usually, the amount of hydrated salt required makes it an impractical medium for controlling relative humidity in a commercial package.

For use in consumable products, such as food or tobacco, many hydrated salts cannot be considered because of undesirable properties of the salt. For example, they may be toxic, or may create off-tastes in foods. Some may undergo chemical reactions with the other substances in the package. Consequently, the number of hydrated salts which can be practically considered is quite limited.

It is also quite difficult to find a hydrated salt which is acceptable for practical application, and which also produces the desired equilibrium relative humidity. And finally, the capacity of hydrated salts to control relative humidity is low. That is, a fairly large amount of hydrated salt is required to maintain control of the relative humidity for even a short period if the ambient conditions are very far from the target conditions.

Saturated salt solutions do not have the same capacity problem as do hydrated salts. There can be a great deal more water per unit volume or per unit weight in a saturated salt solution than in a hydrated salt. Furthermore, it is possible to adjust the initial ratio of excess salt to water, depending on whether the most probable problem expected is that the package will gain water or lose water.

There are also more salts which can be used to make saturated salt solutions, and their properties are well known. Even so, all ranges of relative humidities are not covered, and it is not always possible to find a saturated salt solution which will give exactly the equilibrium relative humidity needed.

Solutions which are saturated in two or more salts give equilibrium relative humidities which are different from those of saturated solutions of the original salts separately. Unfortunately, the equilibrium relative humidity over a solution saturated in two salts cannot be related in a linear manner to the equilibrium relative humidities of the saturated solutions of the individual salts. The interactions of the salts in solution are complex, and the equilibrium relative humidity over a solution saturated in two salts is not readily predicted.

In addition, like hydrated salts, many salts whose saturated solutions give desirable equilibrium relative humidities cannot be used because of other properties of the salts such as toxicity, off-taste problems, induced corrosion, chemical reactions, etc., as discussed above.

A further consideration is the need to contain a solution inside the package in such a way that it can equilibrate with the atmosphere inside the package, and at the same time not spill into the rest of the package, nor wick into the package or its contents. Obviously, an open container cannot be used, and a closed container would not allow equilibration with the atmosphere inside the package.

It would be desirable to be able to provide a device which will buffer the relative humidity in a closed container such as a sealed package of food or a sealed cigarette pack.

SUMMARY OF THE INVENTION

It is an object of this invention to provide a device which will buffer the relative humidity in a closed container such as a sealed package of food or a sealed cigarette pack.

In accordance with this invention, there is provided a device for insertion into a substantially sealed container for maintaining in the container a desired relative humidity. The device includes a buffering substance capable of maintaining the desired relative humidity by liberating water vapor when actual relative humidity falls below the desired relative humidity and by absorbing water vapor when actual relative humidity rises above the desired relative humidity. An enclosure means contains the buffering substance and allows the liberation and absorption of water vapor.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
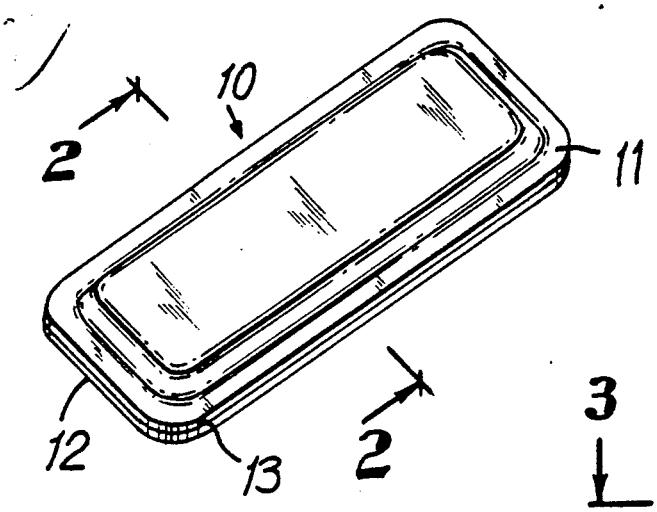
FIG. 1 is a perspective view of a first embodiment of a humidity controlling device according to the present invention.
Figure 2:
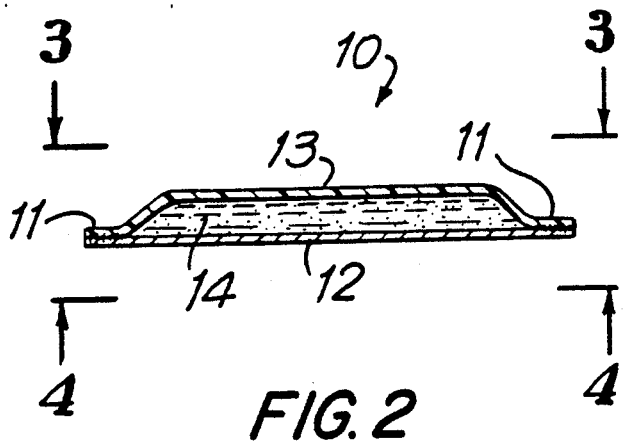
FIG. 2 is a cross-sectional view of the humidity controlling device of FIG. 1, taken from line 2—2 of FIG. 1.
Figure 3:
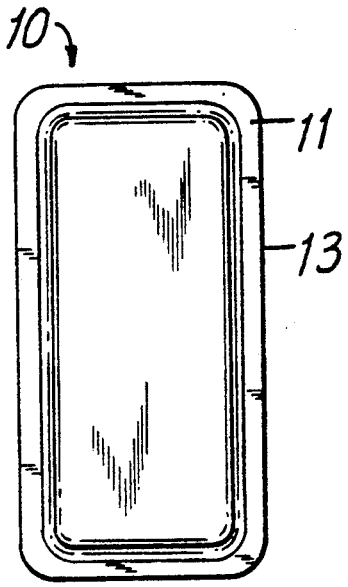
FIG. 3 is a plan view of the humidity controlling device of FIGS. 1 and 2, taken from line 3—3 of FIG. 2.
Figure 4:
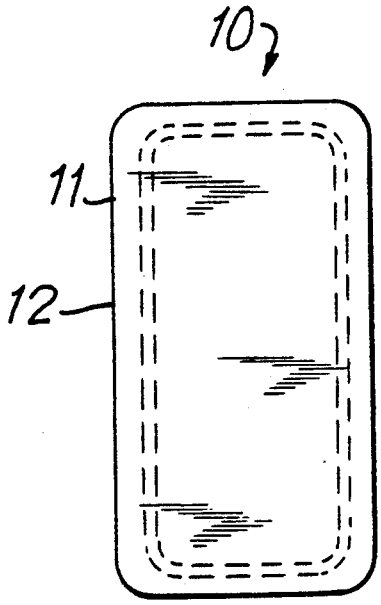
FIG. 4 is a bottom view of the humidity controlling device of FIGS. 1–3, taken from line 4—4 of FIG. 2.

The humidity control device of the present invention is provided as an insert to the container whose internal relative humidity is to be controlled. A first preferred embodiment of a humidity control insert 10 is illustrated in FIGS. 1–4. Insert 10 is in the form of a pouch made by heat sealing a polylaminated foil layer 12 and a microporous or water vapor-permeable membrane 13 around their edges in region 11.

Preferably, polylaminated foil 12 is a laminate of polypropylene or cellulose acetate film and aluminum foil, free of pin holes. The important characteristics of the foil are that it give an impermeable barrier to water, that it be somewhat flexible, and that it not impart any toxic materials to the contents of the package.

Membrane 13 should allow the passage of water vapor while containing the humidity controlling solution itself. This allows the solution to control the humidity inside the package, but protects the package contents from wicking or leaking of the solution. Membrane 13 can either be inherently water vapor-permeable—i.e., water molecules pass directly through the material of the membrane, or it can be impermeable but microporous—i.e., it has microscopic pores in it through which water molecules can pass. If a microporous membrane is used as membrane 13, the preferred microporous membrane 13 is a polypropylene membrane sold by Hoechst Celanese Corporation under the name Celgard 2400. Any microporous film which can contain the buffering solution and allow the transmission of water vapor into and out of insert 10 without allowing the solution iself to pass through the film could be used in place of Celgard 2400. Polylaminated foil 12 gives insert 10 flexibility and structural integrity while providing an impermeable barrier to the contents of insert 10. Microporous membrane 13 has pores with a diameter of about 0.02 microns to allow water vapor to pass through it. The pore diameter should be less than 0.04 microns because of the possibility of wicking of moisture through larger pores, thus reducing or destroying the effectiveness of insert 10.

The required pore size of the microporous film is a complex function of the surface tension of the humidity buffering solution, the nature of the film, the temperature, and the pressure applied to the solution (atmospheric or otherwise).

Instead of microporous films, any film or membrane with a sufficiently high water vapor permeability can be used. A particularly preferred film of this type is a film of cellulose triacetate. The permeability must be high enough that the total volume of water vapor passing through the film area of the insert in a given time is much greater (e.g., approximately ten times greater) than the volume of water vapor escaping in the same time from the much larger surface area of the container (e.g., through imperfect seals or because of the permeability of the container wrapper). Water vapor-permeable films may be preferable to microporous films because they are generally lower in cost.

Insert 10 contains a buffering substance 14 between layers 12, 13. The properties of buffering substance 14 will be described in more detail below.

Figure 5A:
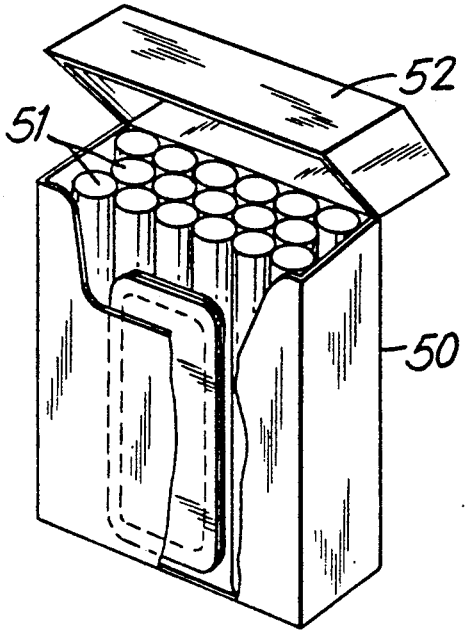
FIG. 5A is a partially fragmentary perspective view of a cigarette pack showing a first possible placement of the humidity controlling device of FIGS. 1–4 therein.
Figure 5B:
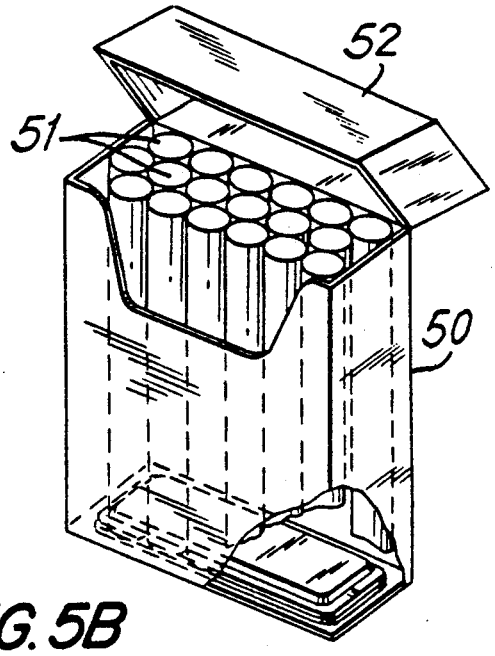
FIG. 5B is a partially fragmentary perspective view of a cigarette pack showing a second possible placement of the humidity controlling device of FIGS. 1–4 therein.

Insert 10 can be placed in any convenient position in the container in which it is used, as long as it is within the same sealed volume the relative humidity of which is to be controlled. FIGS. 5A and 5B show two possible placements in a conventional hinged-lid cigarette box 50. In FIG. 5A , insert 10 is placed between the front of box 50 and the cigarettes 51 within the box. In FIG. 5B, insert 10 is placed at the bottom of box 50, beneath the ends of cigarettes 51. Although not shown, insert 10 could also be placed, for example, at the top of box 30, inside lid 52, or anywhere else in box 50. Also, insert 10 does not necessarily have to be a separate and independent element, but could be built into the package itself. Furthermore, insert 10 could be used to equal advantage in a soft cigarette pack, as well as in any other substantially sealed container.

Figure 6:
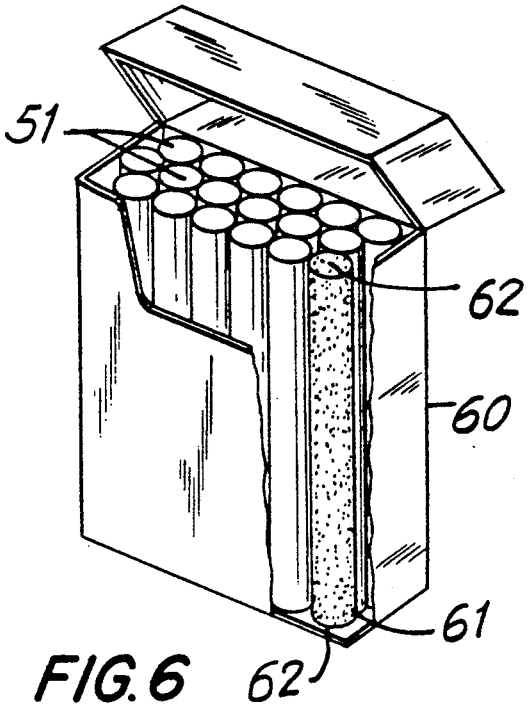
FIG. 6 is a partially fragmentary perspective view of a cigarette pack showing a second preferred embodiment of a humidity controlling device according to this invention and its placement in a cigarette pack.

FIG. 6 shows the placement in cigarette box 60 of a second preferred embodiment 61 of an insert according to this invention. Insert 61 is cylindrical and approximately the size of a cigarette, and is made by forming microporous membrane 13 into a cylinder and sealing the ends 62. Insert 6 1 takes the place of a cigarette in box 60.

Although not shown in FIGS. 5A, 5B and 6, cigarettes in boxes usually are surrounded by an inner foil wrap. It has been found that inserts 10, 61 according to the invention are equally effective whether placed inside or outside of the inner wrap, as long as they are within the same sealed volume as the atmosphere to be controlled. Thus, in a cigarette pack, it is sufficient that the insert 10, 61 be within the polypropylene outer wrap (not shown in FIGS. 5A, 5B and 6).

Figure 7:
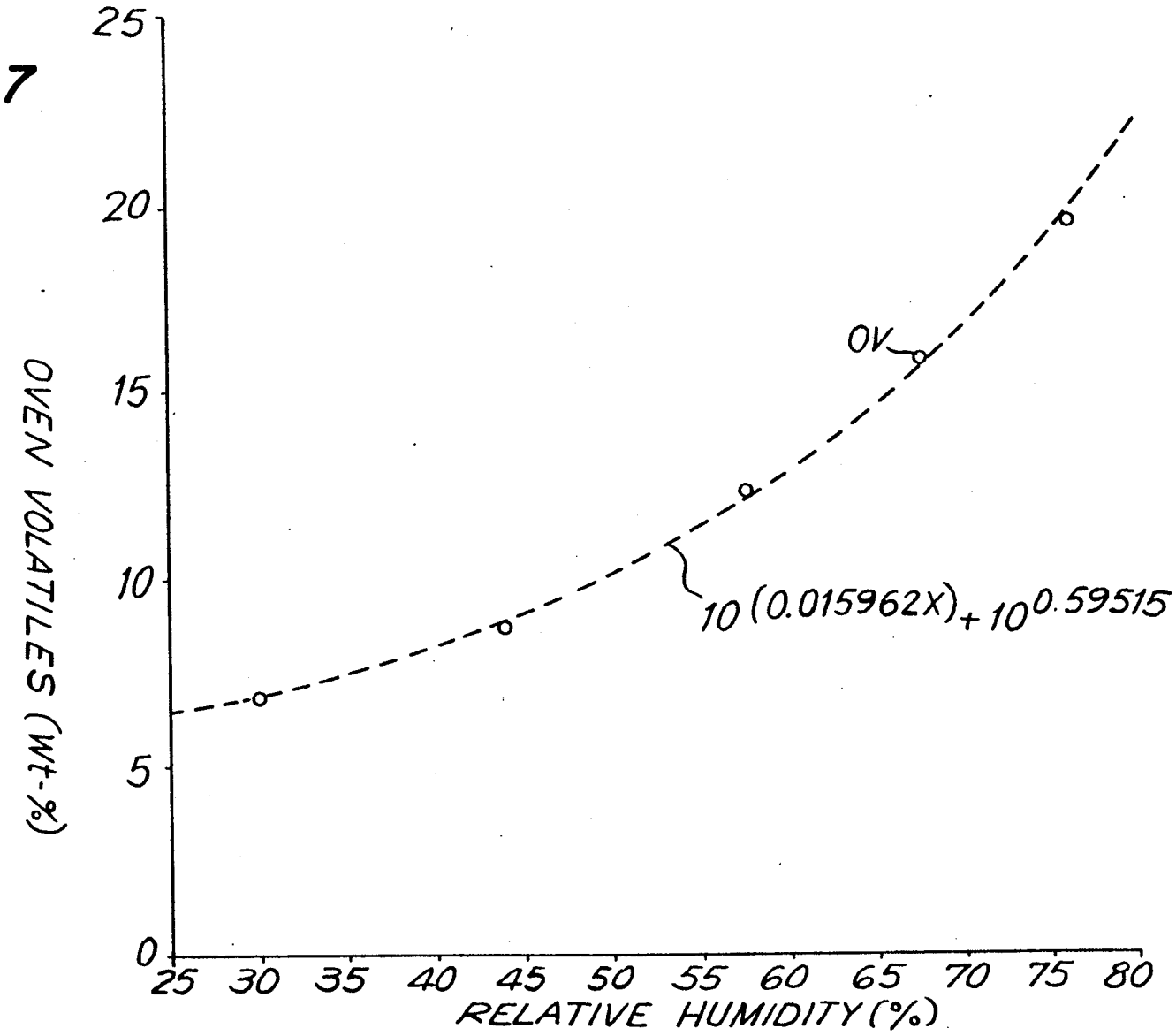
FIG. 7 is a graph showing the equilibrium moisture content of a commercial cigarette filler (tobacco) as a function of ambient relative humidity.

In the case of a cigarette pack, the relative humidity must be such that the oven volatiles (OV) content* of the tobacco filler in the cigarettes is in the desired range of about 12.5%–13%. It is possible to correlate the relative humidity in a sealed cigarette pack with the OV content of the tobacco filler of the cigarettes in the pack. FIG. 7 is a graph that shows such a relationship for one particular commercial cigarette brand. Thus a relative humidity of about 57%-60% will produce an OV content of about 12.3%–13%, which is very close to the desired range of 12.5%–13%. Buffer substance 14** must therefore be chosen to provide the desired relative humidity, e.g., about 56%–62% in the case of cigarettes.

* Oven volatiles (OV) is a measure of the moisture content of tobacco filler. A sample of tobacco filler is weighed and then heated in a forced draft oven at 100° C. for three hours. The sample is weighed again and the weight lost, expressed as a percentage of initial weight, is OV content. Although some of the weight lost is attributable to volatiles other than water, OV is used interchangeably with moisture content because less than 1% of tobacco weight is volatiles other than water.

The curve of FIG. 7 was fitted to the data points shown by plotting the data points against a logarithmic scale, fitting a straight line to the data points by least-squares regression, and using the slope to determine the equation of the curve in FIG. 7**.

In accordance with the present invention, a saturated aqueous salt solution in contact with crystalline salt solute, with a nonelectrolyte modifier if necessary, is used as buffer substance 14. It is well known that saturated salt solutions have well-defined equilibrium vapor pressures, supporting well-defined equilibrium relative humidities. Such solutions are sometimes referred to as constant humidity solutions. If no saturated salt solution gives precisely the relative humidity desired, the solution can be modified by adding another component. Addition of a soluble nonelectrolyte always lowers the equilibrium relative humidity over the solution. Therefore, if one cannot find a salt that supports the desired relative humidity, one selects a salt that supports a slightly higher relative humidity, and then adds a soluble nonelectrolyte in such quantity as to lower the relative humidity to the desired level. While it would be possible to add a judiciously chosen second salt to a saturated salt solution, it is better to use a soluble nonelectrolyte. When mixed salt solutions are generated, the effects are complex, and, as discussed above, differ depending on exactly which salts are involved. The situation is much simpler and more easily controlled when a soluble nonelectrolyte is added. The equilibrium relative humidity of the modified solution may be calculated to a first approximation as the product of the equilibrium relative humidity (as a decimal fraction) of the unmodified saturated salt solution and that of a solution of the soluble nonelectrolyte in the concentration it is to be used, i.e.:

$$\frac{RH_{combined}}{100} \approx \frac{RH_{solute\text{-}1}}{100} \times \frac{RH_{solute\text{-}2}}{100}$$

where:

$RH_{solute\text{-}1}$ is the RH in equilibrium with a solution of solute-1 at whatever concentration of solute-1 is used;

$RH_{solute\text{-}2}$ is the RH in equilibrium with a solution of solute-2 at whatever concentration of solute-2 is used; and $RH_{combined}$ is the RH in equilibrium with a solution of solute-1 and solute-2 at whatever concentrations of solute-1 and solute-2 are used.

Several salts have saturated solutions which support equilibrium relative humidities in or near the range required for a cigarette pack. A salt which has been found to be effective in cigarette packs is tripotassium citrate monohydrate, which forms a saturated salt solution with an equilibrium relative humidity of 62.9%. A glucose solution with an equilibrium relative humidity of 95% is added to form a modified salt solution with a relative humidity of 60%. This is within the general range of 59-61%, which is the desirable range at 75° F. for tobacco blends used in at least some commercial cigarettes. Other blends may require slightly different ranges of relative humidity, but most will fall in the area of 55-75%.

An additional characteristic of the buffer substance of the present invention is that it has a relative humidity temperature dependency which is similar to that of the food or tobacco products contained in the substantially sealed container. This assures that as ambient temperatures change the equilibrium relative humidity of the buffer substance and the food or tobacco products remain relatively constant.

Figure 11:
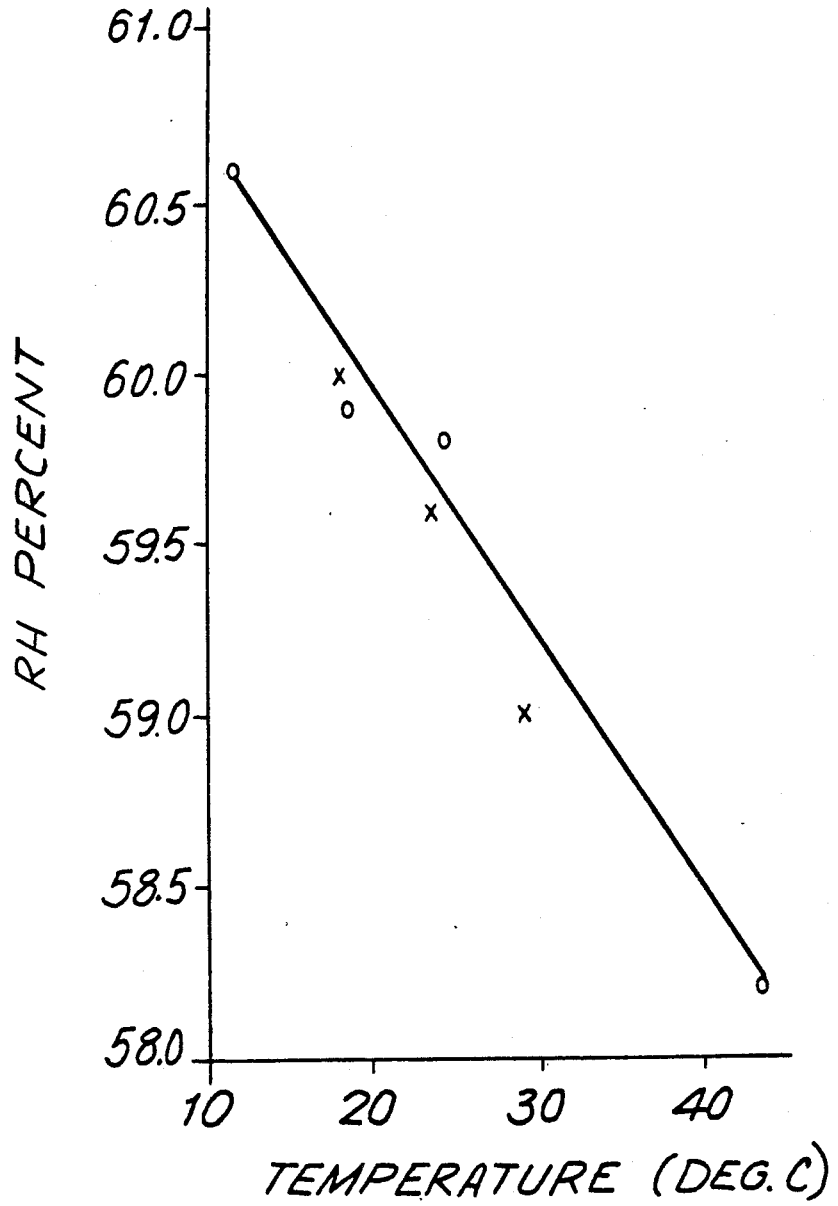
FIG. 11 is a graph showing the relative humidities of a solution saturated in potassium citrate and containing 2.5 molal glucose and of tobacco at an OV of 13.35%, as a function of temperature.

A saturated solution potassium citrate with 2.5 molal glucose solution modifier has a relative humidity temperature dependency similar to that of tobacco. This relationship is shown in FIG. 11.

EXAMPLES

EXAMPLE 1

Preparation of the Humidity Control Device

Inserts 10 were hand assembled from a commercially available sheet of polypropylene laminated on aluminum and Celanese Celgard 2400 membrane using a heated pressure bar with a jaw pressure of approximately 40±5 psi, a dwell time of approximately 1.25 seconds, and a bar temperature of approximately 350° F. The area of contact sealing was approximately one-eighth inch in width around the perimeter of insert 10. One side was left open so that it could be filled with the buffering solution.

The buffering solution was prepared using 200.0 milliliters of water, 90.0 grams of glucose, and no less than 450.0 grams of tripotassium citrate monohydrate. The water was heated to a temperature of about 149° F., and the glucose was added and dissolved by stirring. The tripotassium citrate monohydrate was then added, and dissolved with the aid of heat and stirring. The solution was allowed to cool to room temperature (about 74.3° F.) in a loosely closed vessel. Each insert 10 was filled with three milliliters of the buffering mixture and the open side of each insert was sealed.

EXAMPLE 2

The Effect of the Humidity Control Device on the OV of Cigarettes in Packs under Hot and Dry Conditions (110° F./15% RH)

Inserts 10 were placed into packs of freshly produced commercial cigarettes which were packed with about the desired OV content of 12.5%-13%. The packs were then closed and overwrapped with a commercial polypropylene film overwrap.

Figure 8A:
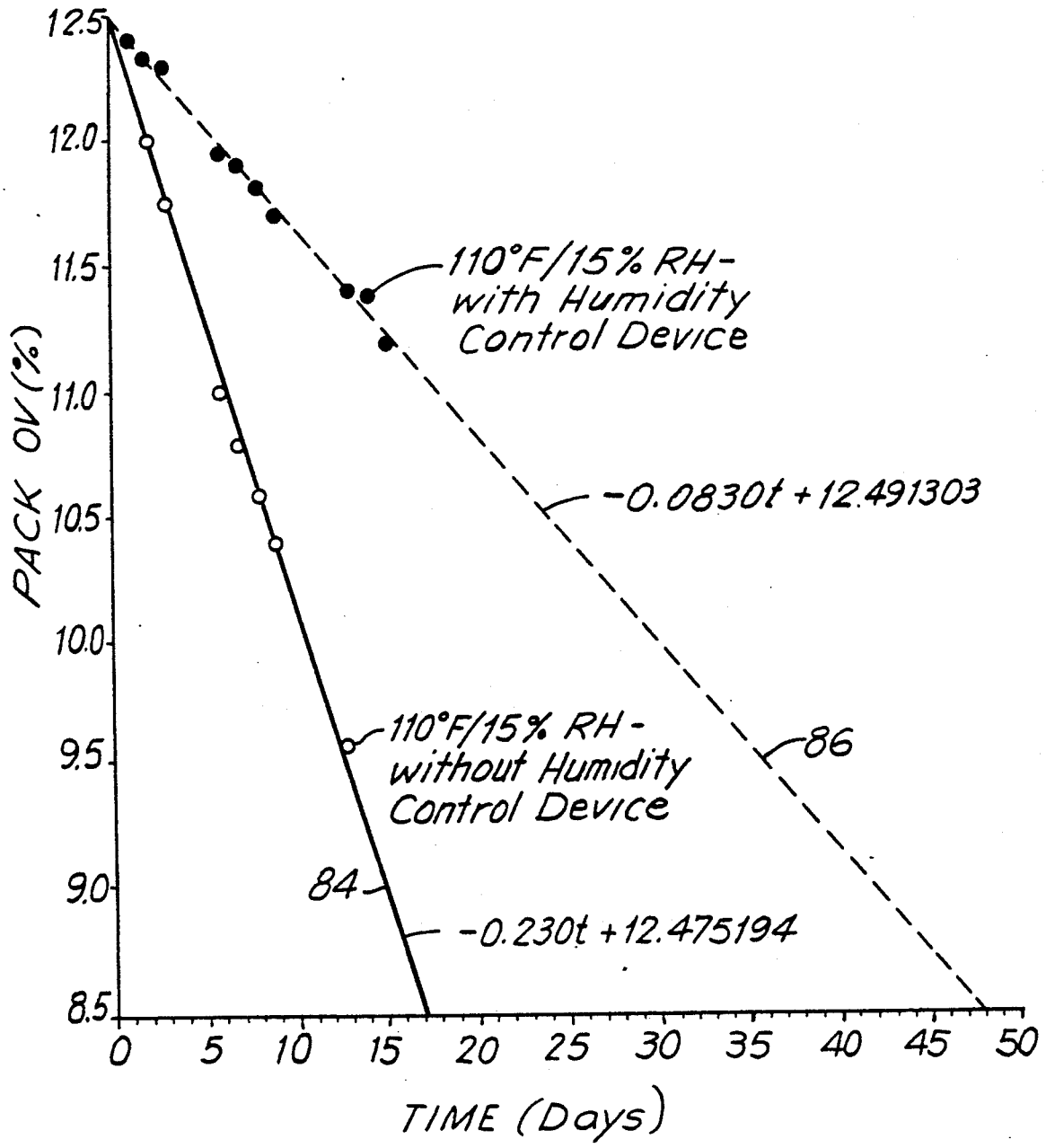
FIG. 8A is a graph showing the moisture content, as a function of time, of cigarettes in packs, stored under hot and dry conditions with and without the humidity controlling device of the present invention.

These packs were stored under hot and dry conditions, i.e., a temperature of 110° F. and a relative humidity of 15% for 17 days. Curves 84 and 86 of FIG. 8A show the OV content of tobacco filler in the control packs and the test packs, respectively. Straight lines were fitted to the data points of curves 84 and 86 using a least squares line-fitting process. The slopes of the two curves (−0.083 and 0.230 percent-OV/day, respectively) show that the tobacco in the packs without insert 10 loses moisture at 2.8 times the rate of tobacco in packs with inserts 10.

EXAMPLE 3

The Effect of the Humidity Control Device on the OV of Cigarettes in Packs under Room Conditions (75° F./40% RH)

Figure 8B:
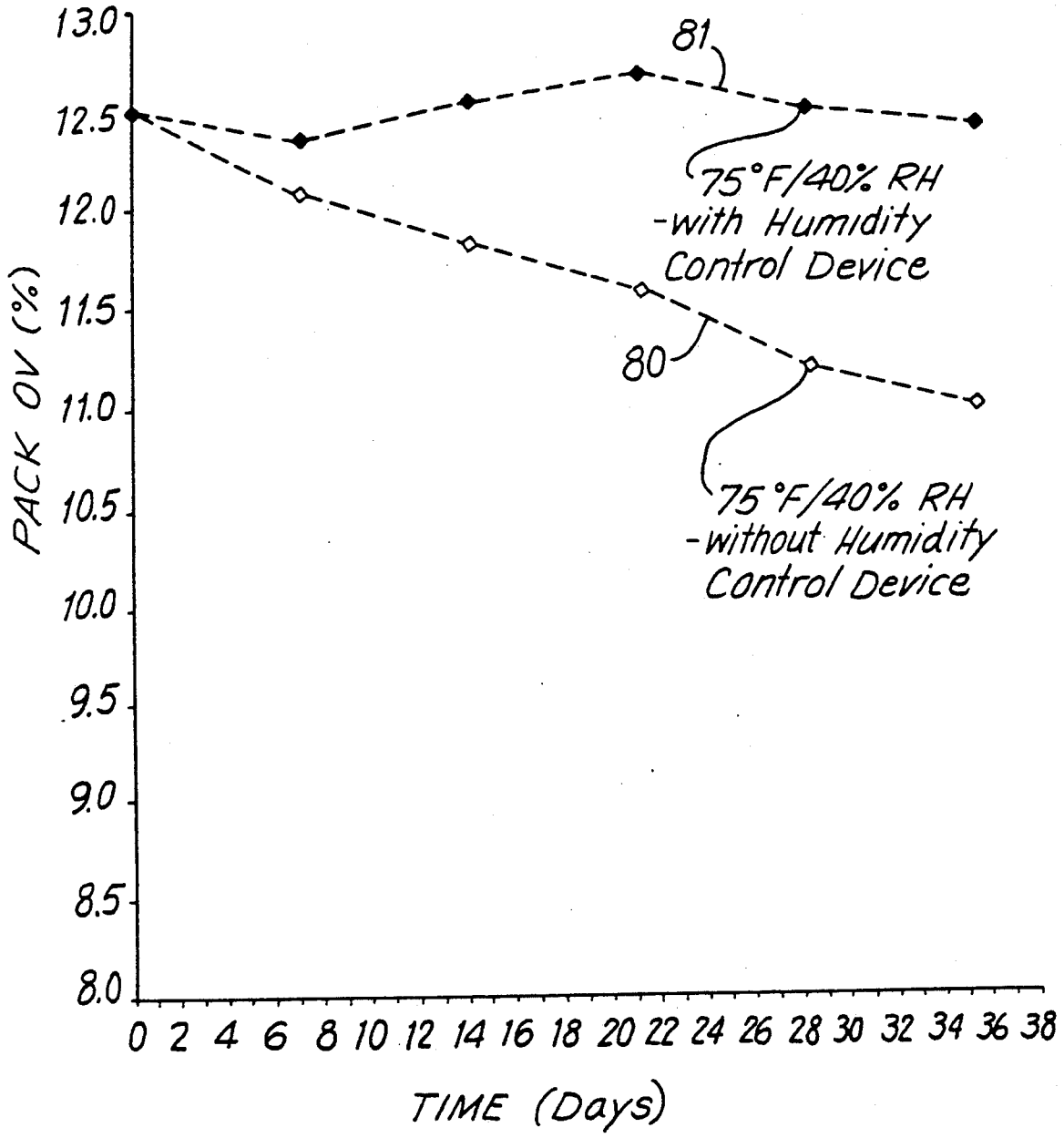
FIG. 8B is a graph showing the moisture content, as a function of time, of cigarettes in packs, stored under room conditions with and without the humidity controlling device of the present invention.

Another set of packs, prepared at the same time and in the same manner as the packs in the preceding example, were stored at room conditions—i.e., a temperature of 75° F. and a relative humidity of 43%.—along with a number of control packs. Curves 80 and 81 of FIG. 8B show the OV content of tobacco filler in the control and test cigarettes, respectively, as a function of time over 28 days. Under these conditions, the OV content of tobacco in packs without the insert 10 dropped from 12.5% to approximately—11.1%, while the packs with inserts 10 remained near 12.5%.

EXAMPLE 4

The Effect of the Humidity Control Device on the OV of Cigarettes in Packs under Cold Conditions (40° F./60% RH)

Figure 8C:
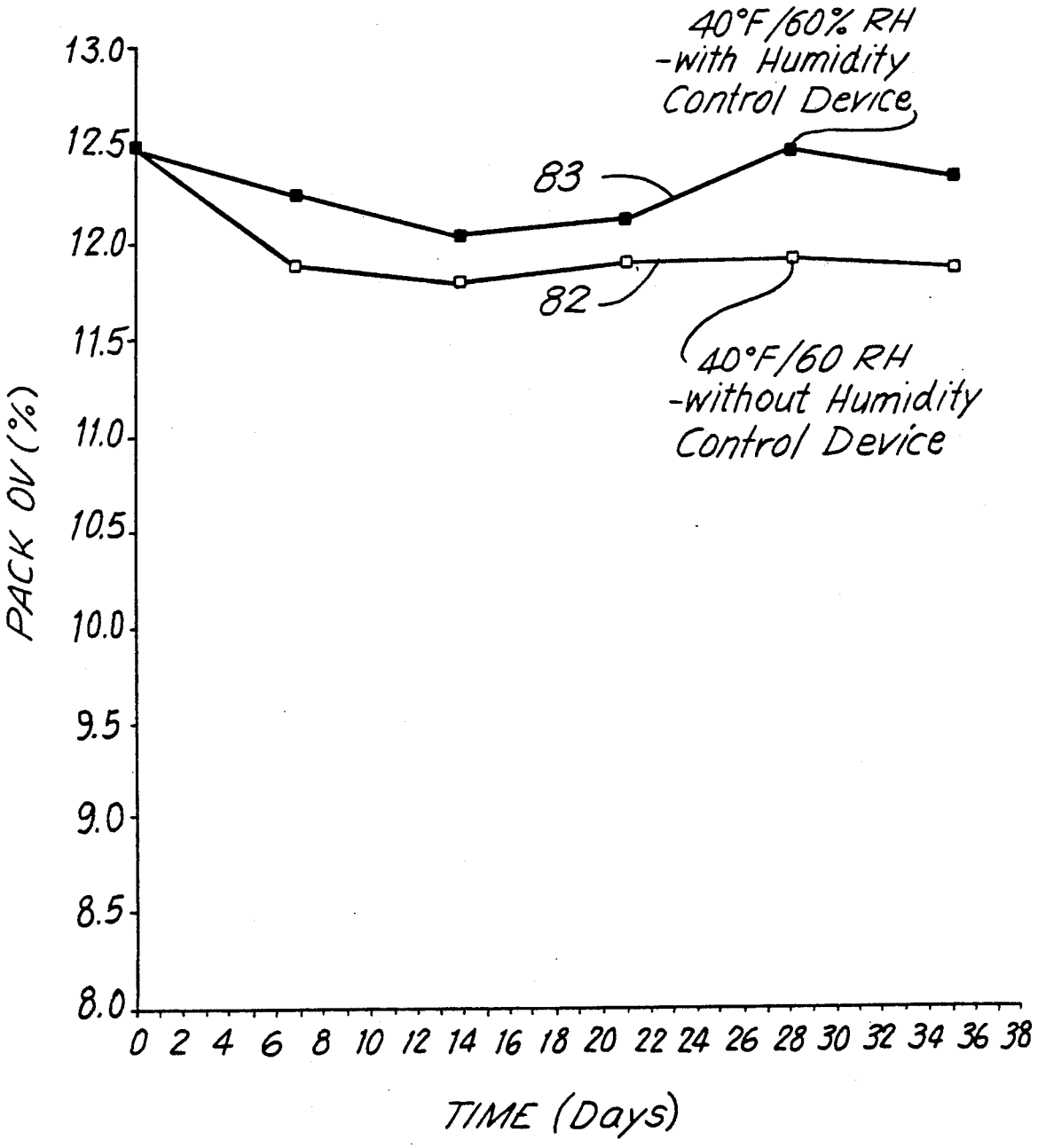
FIG. 8C is a graph showing the moisture content, as a function of time, of cigarettes in packs, stored under cold conditions with and without the humidity controlling device of the present invention.

Another set of packs, prepared at the same time and in the same manner as the packs in the preceding example, were stored under cold conditions, i.e., a temperature of 40° F. and a relative humidity of 60% for 35 days. Curves 82 and 83 of FIG. 8C show the OV content of tobacco filler in the control packs and the test packs, respectively. The two curves show that the tobacco in the packs without insert 10 loses moisture somewhat more rapidly than the tobacco in the packs with inserts 10. The difference observed under these conditions is the least observed under any conditions.

EXAMPLE 5

Equilibration of Commercial Tobacco Filler Over a Saturated Potassium Citrate Solution A saturated aqueous solution of potassium citrate was prepared, and placed in a closed desiccator. Ambient temperature was 74.3° F. The desiccator was not disturbed for three days to allow the atmosphere inside to equilibrate. Then a commercial cigarette filler in an open crystallization dish was placed in the desiccator, and allowed to equilibrate with the atmosphere in the desiccator. After 22 days in the desiccator, the OV of the filler was found to be 14.7%.

EXAMPLE 6

Equilibration of Commercial Tobacco Filler Over a Saturated Sodium Bromide Solution Simultaneously with Example 5, a similar experiment was carried out using sodium bromide in place of potassium citrate. The OV of the filler was found to be 13.3%.

EXAMPLE 7

Equilibration of Commercial Tobacco Filler Over a Saturated Potassium Phosphate Solution An experiment similar to Example 5 was carried out using potassium phosphate as the salt. No time was given for equilibration of the atmosphere within the desiccator prior to adding the filler. After 5 days the OV of the filler was found to be 13.0, and after 8 days two samples were separately measured at 13.2% and 12.7% (Average=12.9%).

EXAMPLE 8

The Effects of Changes in Glucose Concentration on RH and OV

Figure 9:
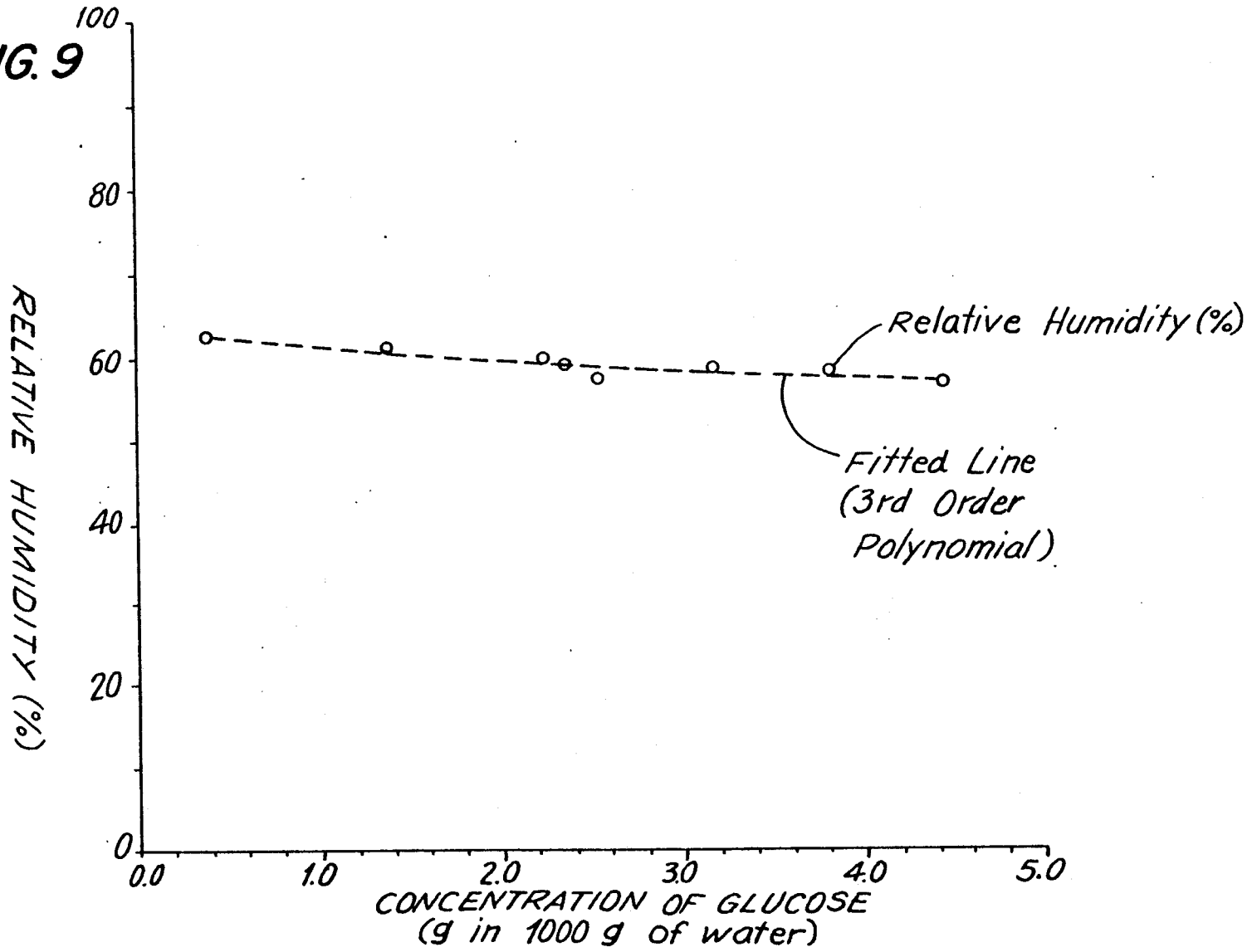
FIG. 9 is a graph showing the relative humidities in equilibrium with aqueous solutions saturated in potassium citrate, and containing concentrations of glucose ranging from 0.4 molal to 4.4 molal.

In order to simulate the effects of loss or gain of water by the humidity controlling solution, a series of solutions were prepared which were saturated in potassium citrate , but which contained less , the same, and more glucose than is ideal for this invention. The solutions were placed in jars with lids equipped with valves which allowed the probe of an electronic RH meter (Vaisala Model HMI-31, sold by Vaisala Inc., of Woburn, Mass.) to be put into the atmosphere inside the jar without removing the lid. The relative humidity was measured over each solution, and recorded. In addition, commercial cigarette filler was equilibrated over the same solutions in a manner similar to that described in Example 5. The results are shown numerically in the Table 1 below, and graphically in FIG. 9.

TABLE 1

| | Variation of Equilibrium RH with Glucose Concentration. | | |
|---|---|---|---|
| Solution Number | Glucose Concentration (Molal) | Relative Humidity (Percent) | Oven Volatiles (Percent) |
| 1 | 4.4 | 57.8% | 12.6% |
| 2 | 3.8 | 59.1 | 13.1 |
| 3 | 3.1 | 59.3 | 13.1 |
| 4 | 2.8 | 58.7 | 12.9 |
| 5 | 2.5 | 57.6 | 12.6 |
| 6 | 2.3 | 59.6 | 13.2 |
| 7 | 2.2 | 60.2 | 13.4 |
| 8 | 1.4 | 61.3 | 13.8 |
| 9 | 0.4 | 62.5 | 14.3 |

Notes:
1. All solutions were saturated in potassium citrate.
2. Measurements were made at 72-73° F. after several days of equilibration.
3. OVs were obtained from an RH-OV isotherm (FIG. 7) which had been previously determined for the filler type used in this example.

These data show that the equilibrium relative humidity over this humidity control solution will change only slightly as the solution either loses to or gains water from the package it is in. This is true for a large glucose concentration range.

EXAMPLE 9

OV of Cigarette Filler Equilibrated Over a Solution of Glycerol and Dipotassium Hydrogen Phosphate An aqueous solution which was 4.1 molal in glycerol and saturated in dipotassium hydrogen phosphate was prepared. Commercial cigarette filler was equilibrated over this solution in the manner described in Example 5. The final OV of the filler was 10.3%.

EXAMPLE 10

OV of Cigarette Filler Equilibrated Over a Solution of Glycerol and potassium Citrate An aqueous solution which was 2.5 molal in glycerol and saturated in potassium citrate was prepared. Commercial cigarette filler was equilibrated over this solution in the manner described in Example 5. The final OV of the filler was 14.0%.

EXAMPLE 11

OV of Cigarette Filler Equilibrated Over a Solution of Glycerol and odium Acetate An aqueous solution which was 7.0 molal in glycerol and saturated in sodium acetate was prepared. Commercial cigarette filler was equilibrated over this solution in the manner described in Example 2. The final OV of the filler was 7.4%.

EXAMPLE 12

Demonstration of the Unsuitability of a Microporous Film with a Pore Size of 0.04 Microns Packets (inserts 10) were prepared in the manner described in Example 1, but with the substitution of Celgard 2500 for Celgard 2400. Celgard 2500 has is similar to Celgard 2400 except that its nominal pore size is 0.04 microns. These packets were put into cigarette packs and stored in hot and dry conditions in the manner described in Example 2. After one week of storage, packs were removed and examined. Damage was evident inside the cigarette packs due to liquid wicking from the packets. The packets themselves felt wet and slippery to the touch, as though the solution were on the outer surface of the Celgard 2500.

EXAMPLE 13

The Effect of the Humidity Control Device on the OV of a Fruited Cereal Under Standard Storage Conditions A quantity of commercial raisin bran breakfast cereal having a water activity ($A_w$) of 0.55 is divided into two portions. Both portions are placed into commercial type breakfast cereal packages, each consisting of an outer paperboard box and an inner pouch which functions as a moisture barrier. The inner pouch is sealed around three edges, and has a zip-type closure on the fourth edge. A humidity control device, similar in construction to, but larger than, those used in Examples 1-12, containing the saturated potassium citrate/2.5 m glucose buffering solution described in Example 1, is put into half of the pouches, and they are closed. The second group of pouches contain raisin bran alone. These are also put into boxes, and the boxes are closed. Both groups of packages are stored under standard "supermarket" conditions. Periodically, one package from each group is opened, and the $A_w$ of the raisin bran is measured. The $A_w$ of the raisin bran stored without the humidity control device drifts out of the acceptable range (0.60 to 0.40) much sooner than does the $A_w$ of that with the humidity control device.

EXAMPLE 14

The Effect of the Humidity Control Device on the OV of Fruit Cakes Under Standard Storage Conditions Two fruit cakes having water activities ($A_w$) of 0.60 are placed on paperboard bases and overwrapped with a film consisting of multiple alternating laminates of polyvinylidene chloride and polyethylene, such as that sold as SARAN WRAP by Dow Consumer Products, Inc., of Indianapolis, Ind., to act as a moisture barrier. A large humidity control device containing the saturated potassium citrate/2.5 m glucose buffering solution described in Example 1 is put inside the overwrap film of one cake. Both cakes are then placed inside the traditional metal containers used for fruit cakes. Both cakes are stored in a chamber at 75° F. and 30% RH for two months. The cake stored with the humidity control device has a significantly higher $A_w$ and is more acceptable to the taste.

EXAMPLE 15

The Effect of the Humidity Control Device on the OV of Pound Cake Under Standard Storage Conditions A group of pound cakes having water activity ($A_w$) of 0.30 is divided into two sets of equal sizes. Both sets are packaged in the same type of standard transparent, sealed packages. The first set of pound cakes is packaged with a large humidity control device containing an aqueous solution which is 4.4 molal in D-glucose and saturated in magnesium chloride. The second set of pound cakes is packaged in the same manner, but without the humidity control devices. The cakes are placed into storage under standard "supermarket" conditions. At regular intervals, pairs of cakes—one from each set—are removed from storage, and their water activity measured. The pound cakes packaged with the humidity control devices are found to have their $A_w$ values closer to the desired level (0.30) at longer periods of storage.

EXAMPLE 16

The Effect of a Humidity Control Device Made With a Water Vapor-Permeable Film on the OV of Cigarette Filler A number of inserts 10 were prepared in a manner similar to that described in Example 1, except that Celgard 2400 was replaced with a cellulose triacetate film (American Hoeschst Corp., Film Division, Type N25 Cellulose Triacetate Film, thickness—25 micrometers, density—32 g/m$^2$) which is water vapor-permeable but not porous or microporous. These inserts were placed in packs of commercial cigarettes. These packs were then placed in polypropylene pouches, which were heat-sealed. Another set of cigrettes was packed similarly, except that the inserts were not included.

Figure 10:
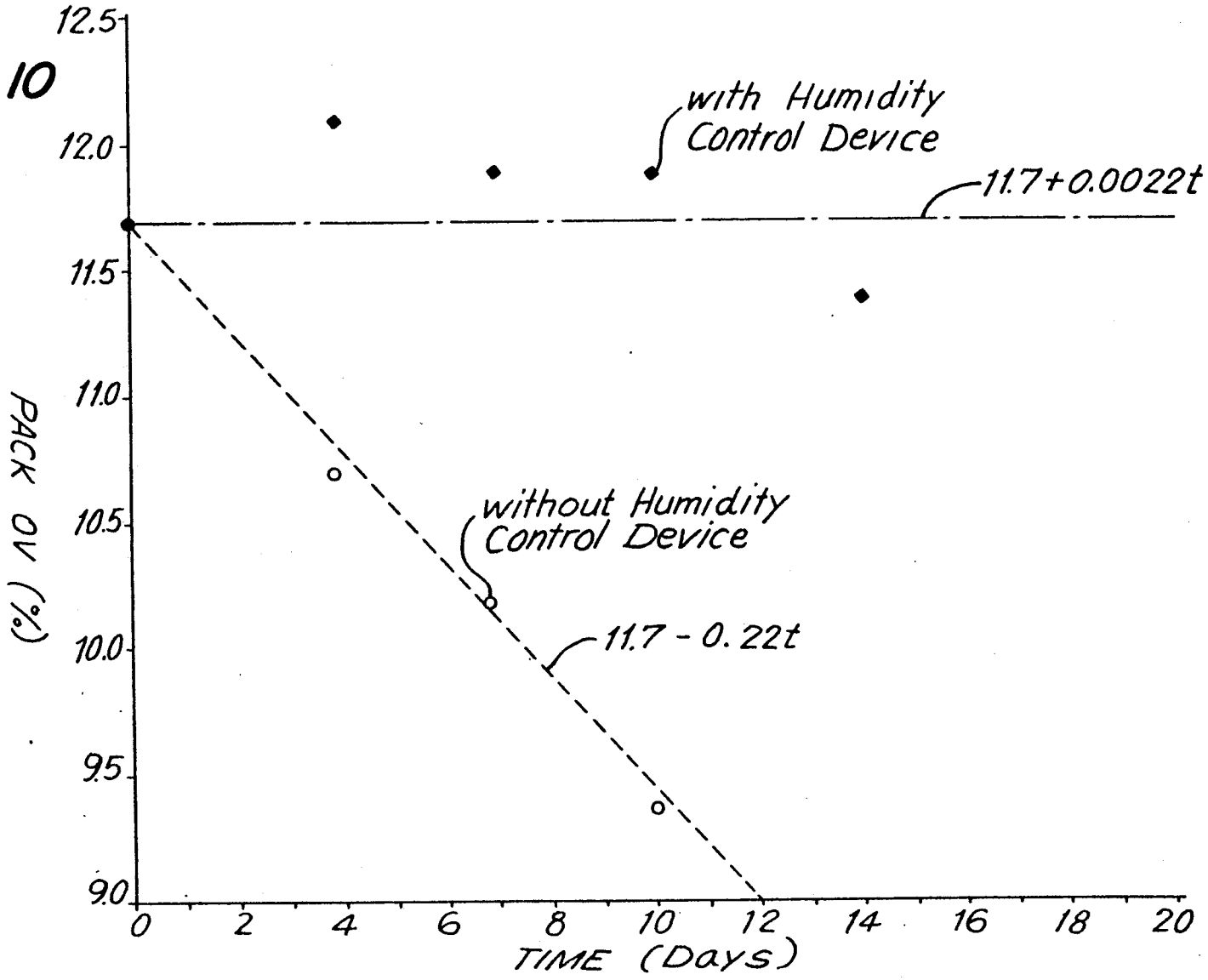
FIG. 10 is a graph showing the moisture content, as a function of time, of cigarettes in packs, stored under hot and dry conditions with and without a humidity controlling device according to the present invention using a water vapor-permeable film.

The OV of one pack of cigarettes from each set was measured immediately, and the remaining packs were stored at 110° F. and 15% RH. Pairs of packs were pulled for OV analysis at 4, 7, 10, and 14 days. The results, shown in Table 2, below, and graphically displayed in FIG. 10, show that the packs which did not contain the inserts reached an unacceptably low OV before 14 days, while packs which did contain the inserts had an OV near the packing OV after 14 days.

TABLE 2

OV Loss of Cigarette Packs Stored Under Hot and Dry Conditions With and Without the Cellulose Triacetate Humidity Control Device

| Time (Days) | OV of Packs Without Humidity Control Device (%) | OV of Packs With Humidity Control Device (%) |
|---|---|---|
| 0 | 11.7 | 11.7 |
| 4 | 10.7 | 12.1 |
| 7 | 10.2 | 11.9 |
| 10 | 9.4 | 11.9 |
| 14 | 8.7 | 11.4 |

The present invention could also be used to maintain the relative humidity in packages other than cigarette packs or food packages. For each application, the appropriate buffering solution would have to be selected, based on both the desired relative humidity and the chemistry of the material the moisture content of which is to be controlled.

Thus, the present invention provides a device which would buffer the relative humidity in a more or less closed container such as a sealed cigarette pack or food package. One skilled in the art will appreciate that the present invention can be practiced by other than the described embodiments, which are presented for purposes of illustration and not of limitation, and the present invention is limited only by the claims which follow.

What is claimed is:

1. A device for insertion into a substantially sealed container for maintaining in said container, at substantially all times after sealing, a desired relative humidity, said device comprising:

a buffering substance capable of maintaining said desired relative humidity by liberating water vapor when actual relative humidity falls below said desired relative humidity and by absorbing water vapor when actual relative humidity rises above said desired relative humidity, said buffering substance further having a relative humidity temperature dependency similar to a food or tobacco product contained in said substantially sealed container; and a means of enclosure for containing said buffering substance and allowing said liberation and absorption of water vapor.

2. The device of claim 1 wherein said buffering substance comprises a saturated solution of a salt capable of maintaining an equilibrium relative humidity at least equal to said desired relative humidity.

3. The device of claim 2 wherein said salt is tripotassium phosphate.

4. The device of claim 2 wherein:

said equilibrium relative humidity is greater than said desired relative humidity; and said buffering substance further comprises a solution of a nonelectrolyte for lowering said maintained relative humidity from said equilibrium relative humidity to said desired relative humidity.

5. The device of claim 4 wherein said salt is a potassium salt.

6. The device of claim 5 wherein said salt is tripotassium phosphate.

7. The device of claim 5 wherein said salt is tripotassium citrate monohydrate.

8. The device of claim 7 wherein:

said desired relative humidity is about 60% at about 75° F.; and said nonelectrolyte solution is an aqueous 2.5 molal solution of glucose.

9. The device of claim 4 wherein the salt is tripotassium citrate.

10. The device of claim 4 wherein the nonelectrolyte is a saccharide.

11. The device of claim 10 wherein the nonelectrolyte is a monosaccharide.

12. The device of claim 11 wherein the nonelectrolyte is a hexose.

13. The device of claim 12 wherein the nonelectrolyte is glucose.

14. The device of claim 4 wherein the nonelectrolyte is a polyol.

15. The device of claim 4 wherein the nonelectrolyte is a polyhydroxylated carbon compound having from 3 to 24 carbon atoms, and from 2 to 24 hydroxyl groups.

16. The device of claim 15 wherein the nonelectrolyte is a saturated polyhydroxylated carbon compound having from 3 to 24 carbon atoms, and from 2 to 24 hydroxyl groups.

17. The device of claim 15 wherein the nonelectrolyte is an alicyclic polyhydroxylated carbon compound having from 5 to 24 carbon atoms, and from 4 to 24 hydroxyl groups.

18. The device of claim 4 wherein the nonelectrolyte is glycerol.

19. The device of claim 1 wherein said enclosure means comprises a microporous membrane.

20. The device of claim 19 wherein said microporous membrane has a pore size of less than 0.04 microns.

21. The device of claim 19 wherein said microporous membrane is hydrophobic.

22. The device of claim 19 wherein said enclosure means further comprises polylaminated foil, said foil being heat-sealed at edges thereof to edges of said microporous membrane, said substance being between said foil and said membrane.

23. The device of claim 1 wherein said enclosure means comprises a water vapor-permeable membrane.

24. The device of claim 23 wherein said membrane has a water vapor-permeability of at least about $1.5\times10^{-11}$ g-cm/(cm$^2$-sec-(cm Hg)) at 74° F.

25. The device of claim 23 wherein said membrane is hydrophobic.

26. The device of claim 23 wherein said enclosure means further comprises polylaminated foil, said foil being heat-sealed at edges thereof to edges of said membrane.

* * * * *